United States Patent [19]

Bobier

[11] 4,269,574

[45] May 26, 1981

[54] FLUID DEVICE

[76] Inventor: Wilfred S. Bobier, 4518 Brightmore, Bloomfield Hills, Mich. 48013

[21] Appl. No.: 892,735

[22] Filed: Apr. 3, 1978

[51] Int. Cl.[3] ..... F01B 13/04

[52] U.S. Cl. ..... 417/506; 417/222

[58] Field of Search ..... 91/499, 487, 506, 507; 417/222

[56] References Cited

U.S. PATENT DOCUMENTS

| | | | |
|---|---|---|---|
| 2,307,041 | 1/1943 | Hawley, Jr. et al. | 91/487 |
| 2,642,810 | 6/1953 | Robinson | 91/499 |
| 3,126,835 | 3/1964 | Kline | 91/507 |
| 3,186,352 | 6/1965 | Anderson | 91/506 |
| 3,364,680 | 1/1968 | Osojnak | 91/505 |
| 3,405,646 | 10/1968 | Thoma | 91/499 |
| 3,621,761 | 11/1971 | Alderson | 91/505 |
| 3,698,287 | 10/1972 | Martin | 91/507 |
| 3,868,889 | 3/1975 | Bobier | 91/506 |
| 3,911,792 | 10/1975 | Heyl | 91/505 |
| 3,933,083 | 1/1976 | Weisonback | 91/504 |

FOREIGN PATENT DOCUMENTS

| | | | |
|---|---|---|---|
| 2204466 | 8/1973 | Fed. Rep. of Germany | 91/506 |
| 2616985 | 11/1976 | Fed. Rep. of Germany | 91/499 |
| 2119107 | 7/1972 | France | 91/499 |
| 1264827 | 1/1972 | United Kingdom | 91/506 |

*Primary Examiner*—William L. Freeh

*Attorney, Agent, or Firm*—Basile, Weintraub & Hanlon

[57] ABSTRACT

A fluid device of the axial piston type having high and low pressure operating passages, one of which may be an inlet and the other an outlet, depending upon the pumping and motoring function of the device. The device is of the variable displacement type having a rotatable cylinder barrel with each end of a plurality of pistons being disposed for reciprication within cylinder bores in the cylinder barrel. The cylinder barrel has cylinder ports successively communicating each of the cylinder bores with arcuate inlet and outlet passages formed in a valve face disposed at one end of the cylinder barrel. The other ends of the pistons extend from the other end of the cylinder barrel and include spherical balls and socket joints which are drivingly engaged by an inclined thrust plate assembly disposed to impart the reciprical stroking movement to the pistons within the cylinder bores as the cylinder barrel is rotated. In one example of the invention means are provided for laterally supporting the cylinder barrel on a drive shaft. The lateral support means is in the form of a coaxial annular land which engages the cylinder barrel at the piston projecting end thereof. The annular land has a lateral centerline spaced axially outwardly from the point of intersection of the shaft axis and the general plane of the locus of the centers of the spherical balls on the projecting ends of the pistons, and the point of intersection is located in a plane between the plane of the ball centers and the valve plate end of the cylinder barrel. The disclosure includes a novel thrust plate assembly technique including a novel displacement control mechanism which is operatively coupled to the thrust plate assembly.

15 Claims, 7 Drawing Figures

FLUID DEVICE

BACKGROUND OF THE INVENTION

I. Field of the Invention

The present invention relates to fluid devices and particularly to fluid devices of the variable displacement, axial piston type which may function either as a fluid motor or as a fluid pump.

II. Description of the Prior Art

Heretofore, fluid pumping and fluid motoring devices of the axial piston type have been constructed of a suitable metal housing having a revolving cylinder barrel provided with a plurality of parallel cylinder bores therein and within which pistons are reciprocally mounted. The pistons are reciprocated by engagement with a thrust plate assembly or the like. A rotary valve mechanism in the form of cylinder ports disposed at end of the cylinder barrel alternately connects each cylinder bore with inlet and outlet passages of the device as the cylinder barrel is rotated.

The thrust plate assembly in fluid devices of the variable displacement type normally takes the form of a yoke having transversely extending pintles rotatably carried in bearings suitably mounted in the wall of the housing. Suitable means are provided to pivot the thrust plate with respect to the longitudinal axis of the drive shaft on which the cylinder barrel is rotated so as to vary the amount of reciprocal movement imparted to the pistons within the cylinder bores and thereby permit a selected variation in the fluid displaced by such axial piston fluid devices. Since the bearings supporting the yoke are mounted to the wall of the housing, the entire force exerted against the thrust plate assembly due to the fluid pressure acting against the pistons within the cylinder barrel bores is taken by the housing. This necessitates a strong metal housing requiring considerable precision of manufacture and results in a larger unit than may be necessary for the displacement that is desired. One attempt to overcome the difficulties encountered in such constructions is disclosed in my U.S. Pat. No. 3,991,658 and No. 3,868,889.

As speed and pressure are increased in fluid devices of the type described, there has always been an accompanying increase in noise. This general increase in noise with increased speed and pressure may be attributed to a number of factors and devices of the axial piston type. First, the frequencies generated by the device increase with speed as the components of the device are subjected to increased, alternating, impact forces; second, the intensity of speed related sounds increases as the impact forces between the components of the device increase; and third, the excitation spectrum of the significant piston harmonics also broadens, thus increasing the number of resonant responses. It would be desirable to provide a fluid piston device wherein the attendant noises and vibration levels may be significantly reduced. The present invention achieves this by providing a novel arrangement of components and a technique for assembling the same so as to achieve a compact unit.

In axial piston devices of the type described, when the same are operating under pressure, certain related areas are so proportioned that the cylinder barrel is positively biased toward the valve plate by that pressure in a manner which is well known to those skilled in the art of such units. For purposes of starting the unit, however, it is necessary that the valve be mechanically biased against the valve plate, and this is normally accomplished by means of a spring disposed between the cylinder barrel and the thrust plate. In such devices the normal thrust component or side thrust of the piston not only creates the driving torque, but also results in a substantial lateral force on the cylinder barrel tending to displace it from its normal position. In counter acting this lateral force, it is important that the cylinder barrel be maintained flatly against the valve plate or the cylinder barrel will lift off completely due to fluid flow conditions between the valve plate and the cylinder barrel interface; and this, of course, renders the device inoperative or may result in scoring of the valve plate and/or cylinder barrel faces. In prior art devices of this type support for the cylinder barrel against lateral displacement has been provided by two general schemes. The first of these is to provide a radial bearing for the cylinder barrel directly interposed between the cylinder barrel and the housing. Such construction is disclosed in the aforementioned United States patents. The second scheme of construction has been to support the cylinder barrel directly on the shaft at the driving connection therewith and transmit the lateral thrust thereon to the housing through the shaft and the shaft support. The second of these schemes has advantages in that the size and weight of the units can be reduced. However, in the past when the cylinder barrel was shaft supported, the means for biasing the cylinder barrel into engagement with the valve plate and for biasing the pistons outwardly against the thrust plate were generally unsatisfactory. In such constructions the cylinder barrel, which runs in an abutting fluid sealing relationship with the stationary valve plate, is constantly pressed toward engagement with the valve plate, and the fluids flowing across the face of the valve plate between the cylinder barrel and the valve plate face provide a hydrostatic fluid film which supports the cylinder barrel. In order to prevent excessive wear or galling of the valve plate face and the cylinder barrel face, applicant provides a unique relationship between the cylinder barrel and drive shaft splines that permits a limited and controlled amount of movement of the cylinder barrel, which is both angular and axial, with respect to the drive shaft so that the cylinder barrel may find its own natural center and freely float on the hydrostatic balanced fluid film and hydrokinetic lubricating film formed between the faces of the cylinder barrel and valve plate. Relevant art with respect to applicant's invention is disclosed in my U.S. Pat. No. 3,890,882.

In designing axial piston pumps of the type described herein, it is necessary for the efficient operation of the axial piston pump that the cylinder barrel always be in contact with the valve plate. As aforementioned, any tendency or any lifting or separation of the space between the cylinder barrel and the valve plate causes considerable flow of fluid between the interface of the cylinder barrel and the valve plate. This results in a considerable reduction of volumetric efficiency, as well as the possibility of the scoring of the valve plate cylinder block interface. If the aforementioned cylinder barrel side load in this type of configuration is transmitted to the shaft, the shaft will, of course, naturally deflect. Conventional pump designs require that the deflection of the shaft be first minimized and, second, that the point of maximum shaft deflection should occur at the midpoint along the axis of the spline. In the present invention the angle at which the spline axis assumes relative the cylinder barrel becomes unimportant. This is due to the fact that the cylinder barrel side load is taken through an enlarged diameter portion on the barrel shaft, and this relationship results in the cylinder barrel being centered with respect to the shaft at all times. Additionally, a considerable amount of deflection can be had by providing an increased clearance between the male and female splines of the cylinder barrel and drive shaft. Examples of prior art apparatuses having structural features similar to the aforementioned are disclosed in U.S. Pat. No. 3,126,835 and No. 3,160,109.

As aforementioned, current pump design technology teaches that the point of contact at which the side load of the cylinder barrel is transmitted to the drive shaft should correspond with the intersection of a plane passing through the piston balls and the drive shaft axis. In the present inventive design the plane passing through the piston ball centers intersects the shaft line at a point offset away from the cylinder barrel and valve plate. This creates an imbalance tending to lift the cylinder barrel away from the valve plate. The imbalance is corrected by proper balancing of the cylinder barrel valve plate interface, and the offset results in the substantial improvement, reducing the overall length of the cylinder barrel and resulting in a smaller overall pump length. The smaller pump length makes it possible to move the load supporting bearings, which are attached to the shaft, closer to each other. Bringing these bearings closer together reduces the amount of stress and deflection on the pump shaft, allowing the shaft to be made smaller and, thus, further reducing the required size of the pump for a particular displacement. Additionally, smaller and more compact units result in a quiet pump. In axial piston pumps where the cylinder barrel side load is transmitted to the shaft through the spline, it is necessary to minimize the amount of shaft deflection in order to minimize the tendency on the part of the shaft deflection to lift the cylinder barrel off the valve plate face. To accomplish this, current pump designs must have very bulky shafts and care must be exercized to establish the maximum shaft deflection point at a point that is close to the middle of the spline. By utilizing the aforementioned loose-fitting relationship between the cylinder barrel spline and the drive shaft spline, the shaft deflection becomes unimportant.

U.S. Pat. No. 3,866,520 is relevant to applicant's invention.

III. Prior Art Statement

In the opinion of applicant and applicant's attorney the aforementioned United States patents represent the closest prior art of which applicant and applicant's attorney are aware.

SUMMARY OF THE INVENTION

The present invention, which will be described subsequently in greater detail, comprises a fluid pumping or motoring device of the axial piston type having a pivotally mounted thrust plate adapted to drivingly engage a plurality of pistons which are reciprocally carried by a cylinder barrel. The cylinder barrel is rotatably carried by a drive shaft in such a manner that the drive shaft has a lateral support which laterally engages and supports the cylinder barrel on the drive shaft. The lateral support includes an annular land that has a lateral centerline spaced axially outwardly from the point of intersection of the drive shaft axis in the general plane of the locus of the center of spherical balls which are carried at the projecting ends of the cylinder barrel pistons. The point of intersection is located in a plane between the plane of the centers of the spherical balls and the valve plate end of the cylinder barrel. The invention includes a uniquely constructed thrust plate which is assembled in a novel manner. The device includes a novel displacement control mechanism having a removable pin which couples the displacement control mechanism to the thrust plate to provide for a simple means for controlling and varying the displacement of the unit.

It is therefore a primary object of the present invention to provide a rotary fluid device of the axial piston type having an improved construction which is readily adapted to low-cost and reliable manufacturing techniques.

It is also an object of the present invention to provide a rotary fluid device of the axial piston type having an improved thrust plate construction.

It is a further object of the present invention to provide a rotary fluid device of the axial piston type having an improved thrust plate construction wherein a simple assembly technique is employed, resulting in a reduction in the size of the device.

It is also an object of the present invention to provide a rotary fluid device of the axial piston type having means for varying the displacement thereof, including a unique coupling member for connecting the thrust plate assembly to the displacement control mechanism.

It is a further object of the present invention to provide a rotary fluid device of the axial piston type having an improved cylinder barrel and drive shaft construction, resulting in a reduction in surface wear and galling between the cylinder barrel and valve face.

It is a further object of the present invention to provide a rotary fluid device of the axial piston type having an improved construction which contributes to the reduction in the general noise radiated by such devices.

Other objects, advantages and applications of the present invention will become apparent to those skilled in the art of such fluid devices when the accompanying description of one example of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
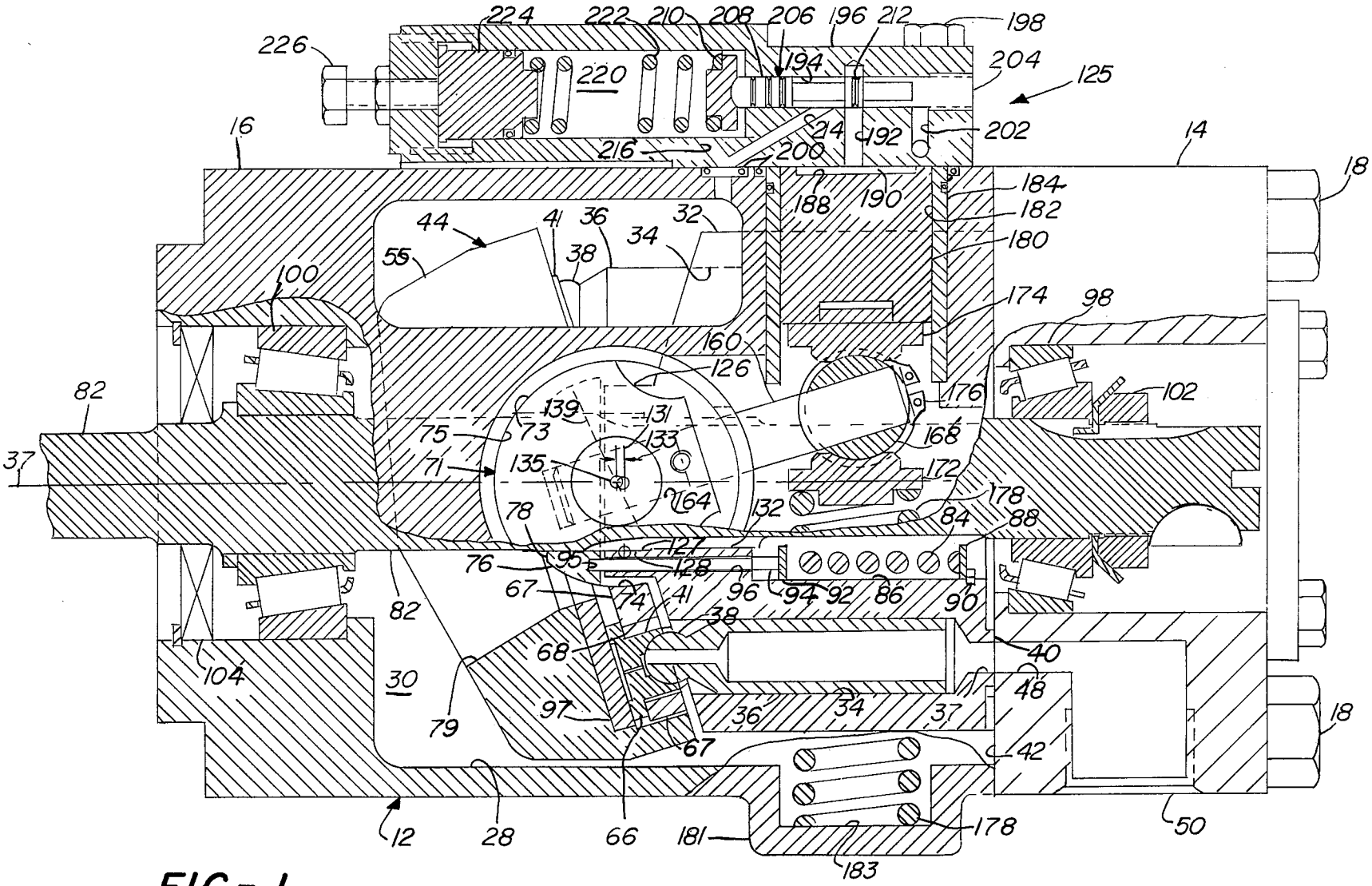
FIG. 1 is a longitudinal, partially sectioned view of one example of a fluid device constructed in accordance with the principles of the present invention with the lower portion thereof being a sectional view taken generally along Line A—A of FIG. 2, while the upper portion of FIG. 1 is a cross-sectional view taken generally along Line B—B of FIG. 2.

Referring now to the drawings and, in particular, to FIG. 1 wherein there is illustrated one example of the present invention in the form of a fluid pump 10 of the axial piston type. The pump 10 comprises a housing 12 which, in turn, comprises two parts: a cover 14 and a case section 16, secured to each other by a plurality of bolts 18 which extend longitudinally through the cover 14 into threaded holes (not shown) in the case section 16. A suitable O-ring seal (not shown) insures a fluid-tight juncture of the two parts when secured to one another. As can best be seen in FIG. 2, the case section 16 includes a pilot portion 22 having a mounting flange 24 to facilitate the mounting of the pump 10 in a desired location. The housing 12 has a longitudinal bore 28 which defines a chamber 30 having a cylinder barrel 32 positioned therein. The cylinder barrel 32 is provided with a plurality of cylinder or piston bores 34, each having a cylinder piston 36 axially and reciprocally mounted therein, and cylinder ports 37 for communicating each of the cylinder bores 34 with the front face 40 of the cylinder barrel 32. The pistons 36 each have spherical ends 38 on which are swaged the socketed shoes 41. The cylinder barrel 32 is positioned axially between a valve plate 42 formed on the inner face of the cover 14 and an inclined thrust plate 44. The valve plate 42 is formed on the left-hand face of the cover 14 and has arcuate ports 48 which serve in a well-known manner to provide a properly phased connection between the cylinder ports 37 and the valve plate ports 48. The cylinder ports 37 will communicate successively with the valve plate ports as the cylinder barrel 32 rotates. The valve ports 48 are connected to external inlet and outlet connection ports (only one of which is shown at 50).

The piston shoes 41 have outwardly extending flanges 66 which are contacted by an annular cage 67 with holes 68 corresponding to each piston 36. The annular cage 67 has a truncated conical bore 74 therein, the same contacting the spherical outer surface 76 of a collar 78 which is provided with a female spline to engage a male spline on a drive shaft 82. A spring 84, positioned in a center recess 86 in cylinder barrel 32, has one end acting against a washer 88 and a snap-ring 90 in the cylinder barrel 32. The other end of the spring 84 is exerted against a washed 92 which abuts a plurality of push rods 94 extending axially through bores 96 in the cylinder barrel 32 into engagement within axially aligned recesses 95 within the collar 78. The force exerted by the spring 84 thus brings the face 40 of the cylinder barrel 32 into engagement with the valve plate 42 and also biases the shoes 41 into engagement with a wear plate 97 carried by the thrust plate 44.

The drive shaft 82 is supported between bearings 98 and 100 which are, respectively, carried by the cover 14 and the housing case 16. The shaft 82 is effective to transmit torque from a prime mover (not shown) to the cylinder barrel 32 through a driving connection at either end of the drive shaft 82. Conventional shaft seals 102 and 104 are, respectively, provided adjacent the bearings 98 and 100, and each is retained in position by snap rings or the like.

Figure 6:
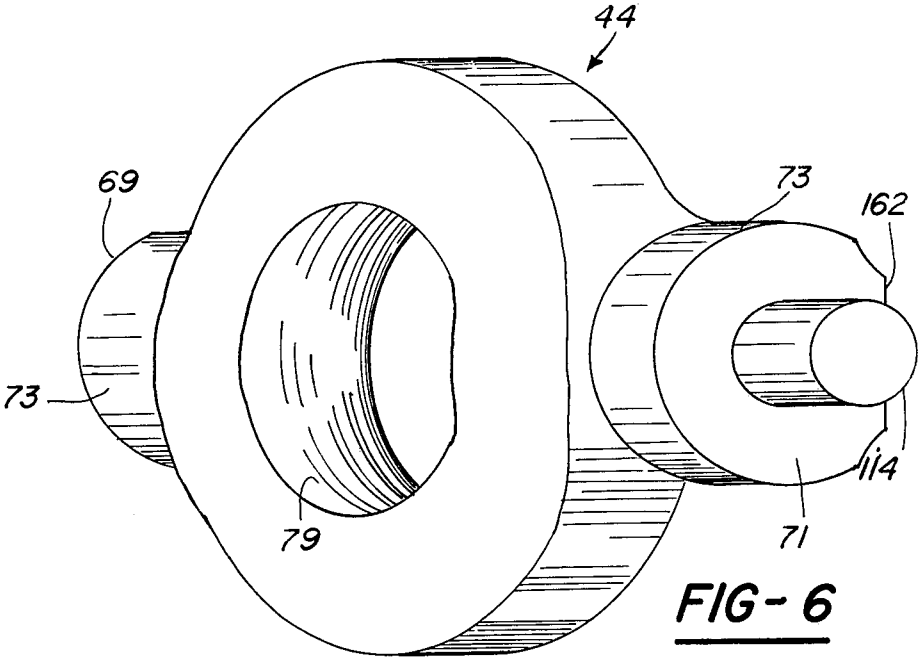
FIG. 6 is another perspective view of the rear, right side of the thrust plate illustrated in FIG. 4.
Figure 5:
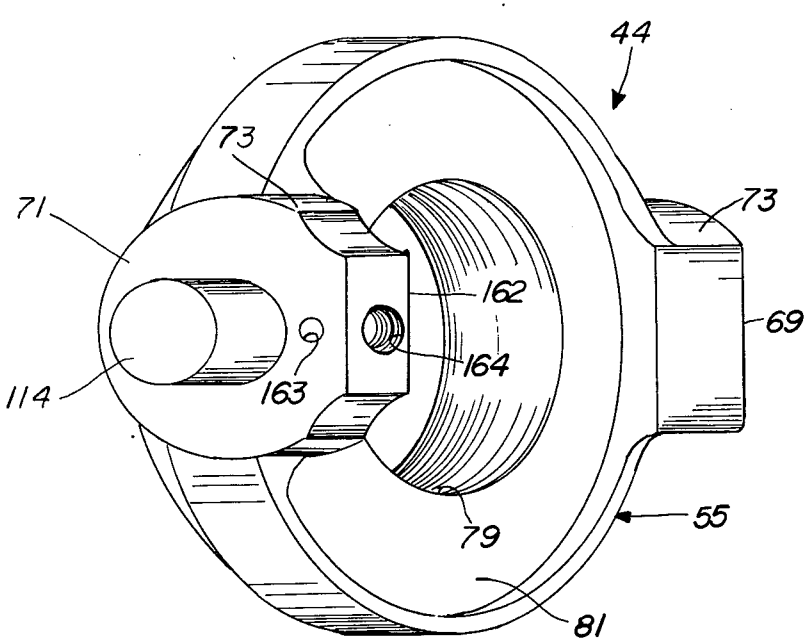
FIG. 5 is a perspective view of the front, right side of the thrust plate illustrated in FIG. 4.

As can best be seen in FIGS. 5 and 6, the thrust plate assembly 44 comprises a movable yoke 55 that has a pair of transversely extending, aligned support pins or trunnions 69 and 71, each of which has arcuately shaped bearing surfaces 73 contoured to mate with arcuately shaped circular bearings 75, which will be described hereinafter. As can best be seen in FIGS. 1 and 5, the arcuately shaped bearing surfaces 73 extend more than an arcuate distance of 90 degrees. Thus, the trunnions 69 and 71 have less than the full diameter of the circular bearings 75 to facilitate their insertion through the housing 12, as will be described hereinafter; however, the trunnions 69 and 71 have more than a half diameter so as to function to hold the yoke 55 in place when reversed loads occur, while at the same time providing full trunnion bearing load support at full pump displacement angles.

Figure 2:
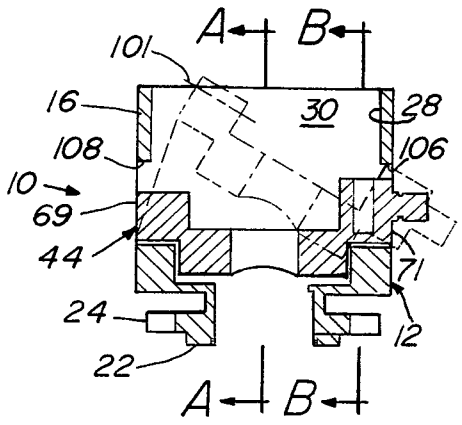
FIG. 2 is a fragmentary, cross-sectional view of the fluid device illustrated in FIG. 1, illustrating the unit in a partially assembled state.
Figure 3:
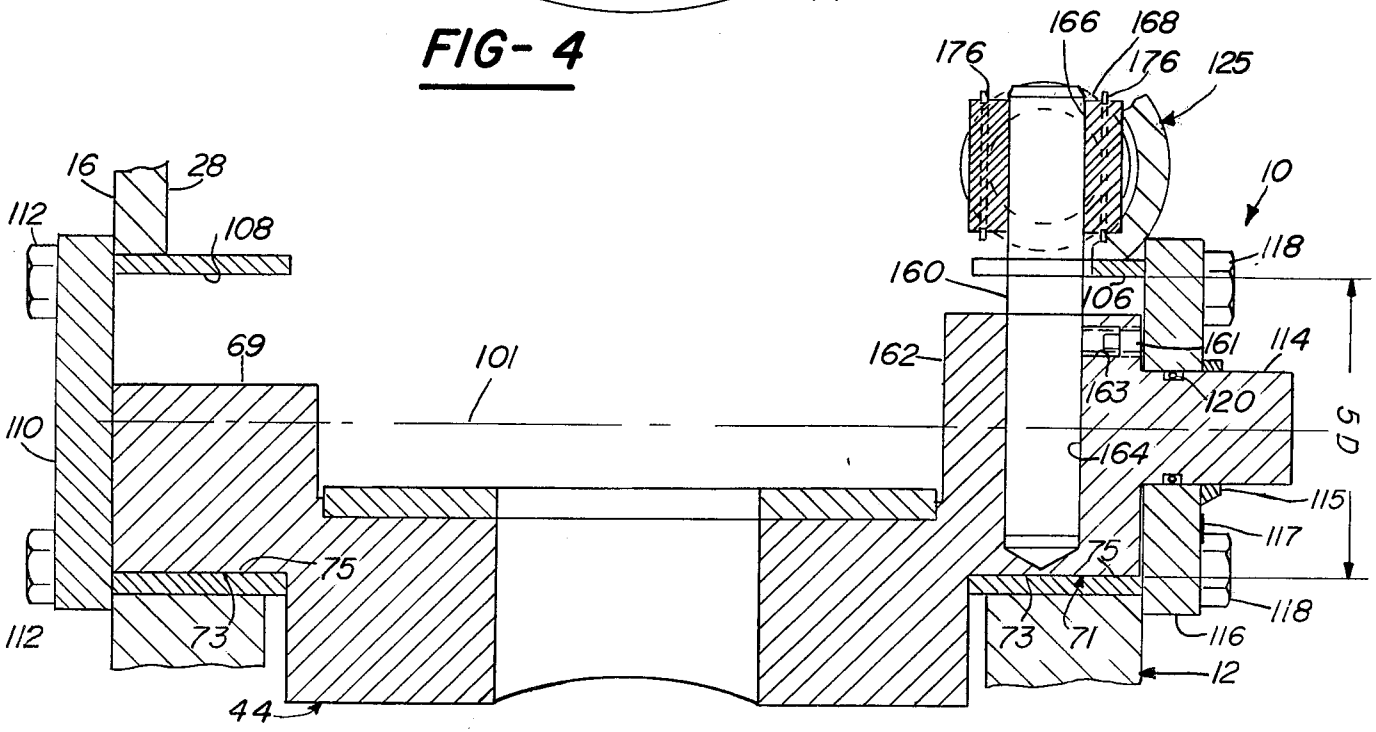
FIG. 3 is an enlarged, fragmentary view of FIG. 2 illustrating a portion of the displacement control mechanism in position.

The central portion of the yoke 55 has a through bore 79 to facilitate the passage of the shaft 82. The yoke 55 further comprises a central portion 81 which mounts the wear plate 97 upon which the shoes 41 abut and ride as the cylinder barrel 32 is rotated. If the wear plate surface has a diameter "D" (FIG. 4) and the distance from the center of the wear plate 97 to the outer edge of the trunnions is preferred to be "0.8 D" (FIG. 4), then the diameter of the trunnions should be "0.5D" (FIG. 3). The ratio of the trunnion diameter to the wear plate diameter is of considerable importance. If the trunnion diameter is too small, the trunnion cannot carry the piston load without breaking. Additionally, a trunnion bearing which is too small precludes the use of inexpensive sleeve bearings, such as the bearings 75, as such inexpensive sleeve bearings cannot sustain high bearing pressures. If the trunnion diameter is too large, then the friction of the trunnion bearing causes a sluggish or a low response of the pump controls. Proper proportioning of the yoke 55 allows for the insertion of the swash yoke 55 into a comparitively small pump housing. The yoke 55 is put in place by laying a yoke axis 101 approximately parallel to the pump axis, as shown in FIG. 2 of the drawings. When the first trunnion 71 is pushed into position and received in the aperture 106 formed on the right side of the pump housing 12, the second trunnion 69 may drop into place in the diametrically opposed aperture 108. The difference between the inside diameter and the outside diameter of the circular bearings 75 allows the necessary clearance for the insertion of the yoke 55 into the housing 12 when the bearings 75 are not in place. After the yoke 55 has been positioned in the manner described and as illustrated in FIG. 2, the sleeve-type bearing members 75 are slid into place over the trunnions 69 and 71 and engage the housing, as shown in FIG. 3. The end of the left trunnion 69 is enclosed by a closure plate 110 which is secured to the housing 12 by bolts 112 that extend through the plate 110 into threaded holes (not shown) in the housing 12. As can best be seen in FIG. 3 of the drawings, the yoke 55 has a rod 114 carried on the right end of the trunnion 71. The rod 114 has a centerline corresponding to the center of the trunnion 71. This rod 114 projects through a pump closure plate 116 and extends outside of the pump housing 12. Closure plate 116 abuts the housing 12 and is secured thereto by bolts 118 that extend through the closure plate 116 and into threaded bores (not shown) in the housing 12. Suitable O-ring 120 prevents the passage of fluid past the relatively movable rod 114 and the closure plate 116. An indicator 115 may be attached to the outer end of the rod 114 to give an accurate indication of pump displacement. Indicia 117 overlaying the closure plate 116 cooperate with the indicator to indicate the pumps displacement. Additionally, a control lever may also be attached to the rod 114 to provide for direct mechanical control of pump displacement. Obviously, an electrical, mechanical or hydraulic control of the pump displacement may be had by means of the rod 114.

As will be described hereinafter in greater detail, the pump displacement is controlled by means of a displacement control mechanism 125, which will be described in greater detail hereinafter.

Referring now to FIG. 1, it can be seen that the cylinder barrel 32 is provided at the piston projecting end thereof with a coaxial, sleeve-like extension or skirt 126, the inner diameter of which provides a bearing surface 127 engaged on a support bearing 128 formed on the shaft 82 provided by an increased diameter land on the shaft 82. The inner surface of the cylinder barrel is splined at 132 and is drivingly connected to the drive shaft by a spline connection formed on the drive shaft 82, whereby upon rotation of the shaft 82 the cylinder barrel 32 will be correspondingly rotated and the support bearing 128 will laterally slidingly support the barrel coaxially on the shaft 82. The support bearing 128 has a lateral centerline located axially outwardly a predetermined distance 133 from the point of intersection 135 of the shaft axis 137 and the general plane 139 of the locus of the centers of the spherical balls 38 at said projecting ends of the pistons 36 and located in a plane between the plane of said centers and the valve plate 42. This arrangement creates an imbalance, tending to lift the cylinder barrel 32 away from the valve plate face 42. This imbalance is corrected by a proper balance at the cylinder barrel valve plate interface. This arrangement results in the reduction of the length of the cylinder barrel 32 which, in turn, results in the reduction of the overall pump length. Because of this design, torque is transmitted through the spline connection from the shaft 82 to the cylinder barrel 32, while the barrel side load is transmitted from the cylinder barrel 32 to the shaft 82 by means of the enlarged diameter land 128.

Figure 7:
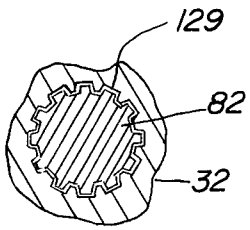
FIG. 7 is a cross-sectional view taken along Line C—C of FIG. 1.

As aforementioned, the face 42 of the cylinder barrel 32 rides on a film of oil disposed between the face of the cylinder barrel and the valve plate face 42. This film of oil is well known to those skilled in the art, and a further detailed description of the same is not necessary. The normal thrust component for side thrust on the pistons 36 creates a driving torque necessary to drive the pump 10 and results in the substantial lateral force on the cylinder barrel 32, tending to displace it from its normal position. The cylinder barrel 32 is restrained from lateral displacement by its engagement with the bearing 128. Although this is effective to restrain the cylinder barrel from moving under the influence of the laterally directed forces as a result of the pressure within the cylinder bores 36, it is necessary for some relative movement between the cylinder barrel 32 and the shaft 82 in order for the cylinder barrel 32 to properly align itself with respect to the shaft 82 and properly float on the hydrostatic film between the valve plate and the cylinder barrel interface. Heretofore, the relative tilting of the cylinder barrel with respect to the shaft has been accomplished by providing a standard female spline on the cylinder barrel 32, while a crown spline is formed on the shaft spline; that is, the spline surfaces slope upwardly from each end to a point near the center of the spline or a weak ended shaft capable of flexing or by use of a carefully proportioned shaft that has the point of maximum shaft deflection occurring at the center of the spline. The cylinder barrel 32 may then rock on the high point in order to obtain the aforementioned proper alignment. Although this method is effective and results in the proper positioning of the cylinder barrel 32 with respect to the shaft and valve plate face 42, it requires weakening the shaft or expensive manufacturing techniques in order to achieve the crowned effect on the drive shaft spline. It is conventional to manufacture splines to control the spline fit by any of three conventionally accepted methods. The first is known as the major diameter fit whereby the fit is controlled by varying the major diameter of the external spline. The second type of control is the minor diameter fit whereby the fit is controlled by varying the minor diameter of the internal spline, and this type of fit is further divided into three subclasses known as the sliding, closed and press or interference fit. The third type of fit is known as the size of teeth fit whereby the fit is controlled by varying the tooth thickness, and it is customarily used for fillet-root splines. All of these various types of techniques are well known to those skilled in the art, and a further detailed description thereof is not necessary except that in all three methods the pitch diameters of the female and male splines are equal. In the preferred embodiment the desired relationship between the cylinder barrel and the drive shaft is obtained by providing an enlarged clearance space 129 (FIG. 7) between the male and female splined portions of the cylinder barrel 32 and drive shaft 82. This may be accomplished in two ways. As aforementioned, the pitch diameters of the male and female splines are equal with the proportions, dimensions, fits and tolerances being governed by the ASA standards (see Darle W. Dudley, Involute Splines, Production Engineering, Volume 28, Page 75, October 1957). In the present invention the desired clearance is obtained by decreasing from 8- or 15-thousandths per inch of pitch diameter of the drive shaft 82 under the standard ASA pitch diameter for the male spline, while maintaining the pitch diameter of the female spline portion at the standard ASA design perimeter. Alternately, the male spline pitch diameter may remain at the standard ASA designation, and the female spline pitch diameter may be enlarged from 8- to 15-thousandths per inch of pitch diameter. Of course, the major and minor diameters must be changed an equal amount to the change in pitch diameter. Both methods result in an enlarged radial clearance between the female and male splines, respectively, of the cylinder barrel 32 and drive shaft 82 providing the necessary increased clearance to permit a slight rocking or tilting of the cylinder barrel 32 with respect to the drive shaft 82 to facilitate the obtaining of the proper interface relationship between the cylinder barrel face 40 and the valve plate face 42. Thus, the complementary configuration of the male and female splines of the cylinder barrel 32 and the drive shaft 82 provides a self-centering alignment between the two elements by means of the different pitch diameters of the male and female splines, all of which results in an extremely less expensive manufacturing operation than the aforementioned types of spline constructions.

Figure 4:
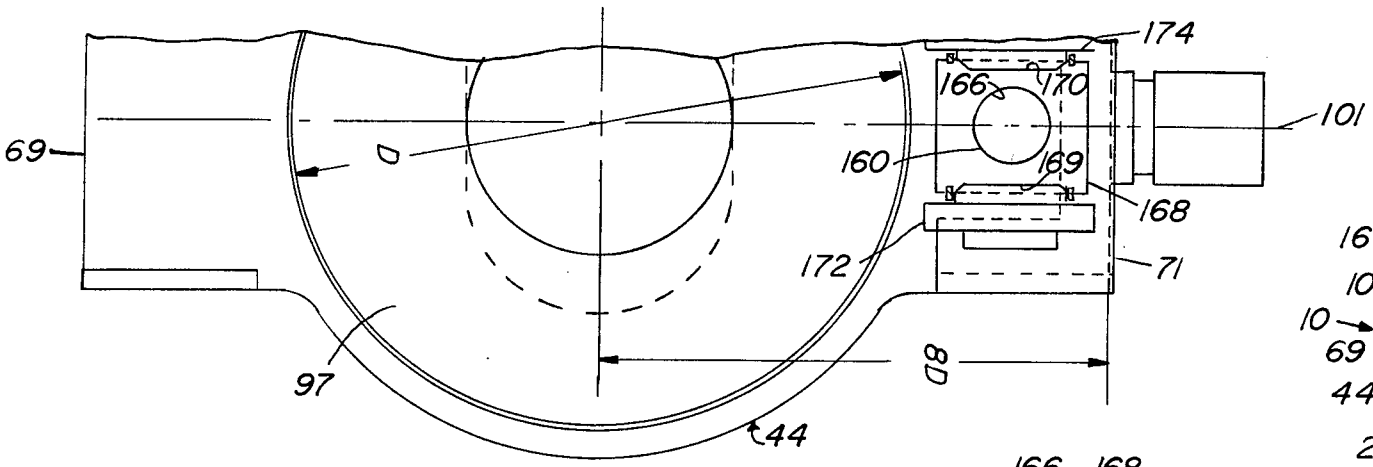
FIG. 4 is a fragmentary top view of FIG. 3.

Referring now to FIGS. 1, 3 and 4 of the drawings for a detailed description of the displacement control mechanism 125.

The amount of reciprocal motion of the pistons 36 within their respective bores 34 and, thus, the amount of fluid displaced by the pump 10 are controlled by the angle of inclination of the thrust plate 44 with respect to the axis of rotation of the cylinder barrel 32. When the face of the movable yoke 55 is perpendicular to the axis of rotation of the cylinder barrel 32, there will be a minimum amount of reciprocal movement of the pistons 36 within their respective bores 34 and, thus, a minimum amount of no-flow condition will exist. As the movable yoke 55 is tilted or inclined with respect to the longitudinal axis of rotation of the cylinder barrel 32, the amount of reciprocal movement between the pistons 36 and their respective bores 34 will increase until the movable yoke 55 has been inclined with respect to the axis of rotation of the cylinder barrel 32 to a maximum amount. The tilting of the movable yoke 55 to impart a reciprocal motion to the pistons 36 with respect to their cylinder bores 34 is well known to those skilled in the art of axial piston pumps and motors, and a further detailed description thereof is not deemed necessary. The movement of the yoke 55 to various positions with respect to the rotating axis of the cylinder barrel 32 is accomplished by means of a coupling pin 160 and a suitable displacement control mechanism, such as mechanism 125 to be described hereinafter. As can best be seen in FIGS. 1, 3 and 5 of the drawings, the right end trunnion 71 of the movable yoke 55 has a radially enlarged section 162 which is provided with a radial bore 164. The coupling pin 160 is inserted into the radial bore 164 and is thus aligned with the point of rotation of the thrust plate 44. The coupling pin 160 is retained in position by engagement with a set screw 161 extending through lateral threaded bore 163 in the enlarged section 162.

The coupling pin 160 follows an arcuate path and will rotate the thrust plate 44 between the no-flow and maximum-flow conditions, as described hereinbefore. The coupling pin 160 protrudes from the face of the trunnion 71 and its projecting end is slideably received within a bore 166 of a cylindrically shaped connecting member 168. The connecting member 168 has recessed portions 169 and 170 which respectively receive seats 172 and 174. Suitable snap rings 176 function to retain the seats 172 and 174 in proper engagement with the cylindrically shaped connection member 168. As can best be seen in FIG. 1, the lower seat 172 engages a spring 178 which has its opposite end seated in a recess 183 formed within a boss 181 of the housing 12. It can be seen that the coil spring 178, being of a compression type, exerts an upward force against the seat 172 and, thus, against the connecting pin 160 to rotate the same counterclockwise, as viewed in FIG. 1, thus rotating the thrust plate 44 to a maximum-flow position.

The coupling pin 160 is removable from the bore 164 and provides a unique assembly means for assembling the pump while still having a substantial compact housing.

The seat 174 is formed on the inner end of a piston 180 that is slideably mounted in a piston bore 182. The piston bore 182 is defined by sleeve member 184 that is suitably mounted within the housing case 16. The outer end of the piston 180 has a recess 188 that defines a pressure chamber 190 which communicates via lateral passageway 192 with a spool bore 194 formed in a pressure compensator housing 196. The pressure compensator housing 196 is attached to the outside surface of the housing 12 by any suitable means, such as bolts 198, that extend through the housing 196 and into threaded engagement with suitable threaded bores in the housing 12. Suitable O-rings 200 are disposed between the juncture of the housing 12 and the pressure compensator housing 196 to prevent the passage of fluid leakage thereby. The pressure compensator housing 196 includes a passageway 202 which communicates high pressure from the pressure port 50 to the spool passageway 194. A suitable plug 204 encloses the opened end of the spool passageway 194. The spool passageway 194 slideably mounts a spool 206. Spool 206 has an outer land 208 which has a curved end that is seated in a spring seat 210, while a second land 212 is removable to a first position, opening communication between the pressure passageway 202 and the spool lateral passageway 192 so as to communicate fluid under pressure from the pressure passageway 202 to the recess pressure chamber 190 behind the piston 180. Pressure exerted on the piston member 180 moves the piston downwardly against the bias of the spring 178 to rotate the coupling pin 160 in a clockwise direction and thus rotate the thrust plate 44 toward a vertical position, decreasing the amount of reciprocal movement of the pistons 36 within their respective piston bores 34. When the spool 206 is shifted to the right to its second position, it closes communication between the lateral bore 192 and the pressure passageway 202 and opens communication with the case pressure via case bore 214. Case pressure is also communicated via lateral bore 216 to an enlarged chamber 220 formed to the left of the spool passageway 194. The enlarged chamber 220 mounts a spring 222 which has one end carried by the seat 210 to exert a biasing force against the spool 206 so as to normally close communication between the pressure passageway 202 and the pressure chamber 190 of the piston 180. The opposite end of the spring 222 is seated against a movable member 224. The member 224 is, in turn, carried at the end of an adjustable screw 226 which permits the position of the member 224 to be varied, thereby varying the amount of tension exerted by the coil spring 222 on the spool 206. When the pressure in the pressure passageway 202 increases to a predetermined amount, the spool 206 will move to the left against the spring 222 to open communication between the pressure passageway 202 and the lateral passageway 192, thereby communicating fluid under pressure to the pressure chamber 190 to shift the piston 180 downwardly to decrease the stroke of the pump.

It should also be noted that the engagement of the push rods 94 with the recesses 95 and the collar 78 provides a number of substantial advantages not heretofore recognized in the prior art. It has been recognized that it is desirable to prevent the collar 78 from rotating, as such rotation will wear at the point of contact with the push rods 94 and at the point of contact with the drive shaft 82. One known method which has been utilized to prevent such movement has been to extend the shaft spline and provide a mating female spline on the inner diameter of the collar 78 which will engage the extended spline on the shaft 82. This, however, results in substantial weakening of the drive shaft 82, as well as considerable additional expense because of the need to provide splines on the shaft at the ID of the collar.

It can thus be seen that the present invention provides a new, rugged, compact and low-cost fluid pump of the axial piston type which may function either as a pump or motor and which has a new, simple and improved means for controlling the displacement of the pump for insuring the proper rotation of the cylinder barrel on a valve plate surface in a simple and economical fashion.

While a form of the present invention as disclosed herein constitutes the preferred form, it should be understood by those skilled in the art of fluid pumps that other forms may be had, all coming within the spirit of the invention and scope of the appended claims.

What is claimed is as follows:

1. A fluid pressure energy translating device of the axial piston type, said device comprising:

a longitudinally disposed housing;

a longitudinally disposed cylinder barrel rotatably mounted within said housing, said cylinder barrel having a plurality of arcuately spaced cylinder bores and cylinder ports communicating each of said cylinder bores with one end of said cylinder barrel;

a plurality of pistons with inner ends disposed for reciprocal stroking movement within said cylinder bores, one end of each of said pistons projecting from the other end of said cylinder barrel bores;

a valve face having arcuate passages, said valve face and said one end of said cylinder barrel being disposed for relative rotary movement with said cylinder ports communicating successively with said arcuate passages in said valve face;

thrust plate means disposed adjacent said other end of said cylinder barrel and mounted in said housing for inclination about an axis at right angles to the longitudinal axis of said cylinder barrel;

spherical ball and socket joints between the projecting ends of said pistons and said thrust plate means to provide for reciprocation of said pistons in said cylinder bores relative to said cylinder barrel in response to the rotation of said cylinder barrel relative to said thrust plate;

means providing lateral support for said cylinder barrel, said lateral support means having a shaft which supports said barrel;

axially spaced bearing means carried by said housing, said bearing means supporting said shaft, said shaft having a coaxial, annular land intermediate said axially spaced bearing means, said land being slidingly engaged with said other end of said cylinder barrel to laterally support the barrel coaxially on the shaft and align said one end to float on a film of oil between said one end and said valve face having sufficient clearance with said barrel other end to provide a slidable and tiltable engagement therebetween said cylinder barrel having a splined section located axially inwardly of said cylinder barrel end; and said shaft having a mating splined section located axially inwardly of said land and engaging said cylinder barrel spline so as to transmit torque thereto and drive said cylinder barrel about said shaft axis and allow the barrel to move laterally when radial and tiltable motion occurs between the land and barrel.

2. The fluid pressure energy translating device defined in claim 1 wherein the male and female splines on said cylinder barrel and shaft, respectively, have complementary configurations for permitting self-centering alignment between said cylinder barrel and said drive shaft such that said cylinder barrel will float on said valve plate and said cylinder barrel will be centered with respect to said bearing means, wherein said female spline has a configuration which is greater than the configuration of said male spline such that there is an enlarged radial clearance between said splines.

3. A fluid pressure energy translating device of the axial piston type, said device comprising:

a longitudinally disposed housing;

a longitudinally disposed cylinder barrel rotatably mounted within said housing, said cylinder barrel having a plurality of arcuately spaced cylinder bores and cylinder ports communicating each of said cylinder bores with one end of said cylinder barrel;

a plurality of pistons with inner ends disposed for reciprocal stroking movement within said cylinder bores, one end of each of said pistons projecting from the other end of said cylinder barrel bores;

a valve face having arcuate passages, said valve face and said one end of said cylinder barrel being disposed for relative rotary movement with said cylinder ports communicating successively with said arcuate passages in said valve face;

thrust plate means disposed adjacent said other end of said cylinder barrel and mounted in said housing for inclination about an axis at right angles to the longitudinal axis of said cylinder barrel;

spherical ball and socket joints between the projecting ends of said pistons and said thrust plate means to provide for reciprocation of said pistons in said cylinder bores relative to said cylinder barrel in response to the rotation of said cylinder barrel relative to said thrust plate;

said thrust plate means comprising a pivotal yoke having a bearing surface adapted to cooperate with said piston ball and socket joints to impart a reciprocal motion thereto, said movable yoke having a pair of axially aligned trunnions defining an axis about which said yoke may be pivoted;

a pair of circular bearings removably insertable about said trunnion pins to rotatably mount said trunnion pins to said housing, said trunnions having an arcuate length less than the full diameter of said bearings, said trunnions having more than a half diameter to hold said trunnions in place when reverse loads occur thereon.

4. The fluid pressure energy translating device defined in claim 3 wherein said bearing surface has a diameter "D" and the distance from the center of said bearing surface to the edge of one of said trunnions is 0.8 D, said trunnions having a diameter of 0.5 D.

5. The fluid pressure energy translating device defined in claim 3 wherein one of said trunnions extends externally of said housing; and means carried by said extending trunnion for indicating the degree of movement of said trunnion with respect to the longitudinal axis of said drive shaft.

6. The fluid pressure energy translating device defined in claim 3 further comprising means providing lateral support for said cylinder barrel, said lateral support means having a shaft which supports said barrel; axially spaced bearing means carried by said housing, said bearing means supporting said shaft, said shaft having a coaxial, annular land intermediate said axially spaced bearing means, said land being engaged with the other end of said cylinder barrel to laterally support the barrel coaxially of the shaft, said land having a lateral centerline spaced axially outwardly from the point of intersection of the shaft axis with the general plane of a locus of the centers of the spherical balls at said projecting ends of said pistons and located in a plane between said plane of said centers and one end of said cylinder barrel.

7. The fluid pressure energy translating device defined in claim 6 wherein said cylinder barrel has a splined section located axially inwardly of said cylinder barrel end, said shaft having a mating spline section located axially inwardly of said land, wherein the male and female splines on said cylinder barrel and shaft, respectively, have complementary configurations for permitting self-centering alignment between said cylinder barrel and said drive shaft such that said cylinder barrel will float on said valve plate and said cylinder barrel will be centered with respect to said bearing means, wherein said female spline has a configuration which is greater than the configuration of said male spline such that there is an enlarged radial clearance between said splines.

8. The fluid pressure energy translating device defined in claim 3 comprising a coupling pin carried by said thrust plate trunnion, said coupling pin being removably attached to aid trunnion, said coupling pin being movable with said trunnion along an arcuate path, said thrust plate being movable along said arcuate path when said coupling pin is moved along said arcuate path; a support member having a through bore slideably receiving said coupling member, said coupling pin being reciprocally mounted in said housing and movable along a path generally perpendicular to the axis of rotation of said cylinder barrel, said support member pivoting said coupling pin along said arcuate path when said support member is moved along said linear path and said coupling pin reciprocally slides within said support member bore whereby the degree of inclination of said thrust plate with respect to the axis of rotation of said cylinder barrel may be selectively varied.

9. The fluid pressure energy translating device defined in claim 8 further comprising a displacement control mechanism carried by said housing and operatively coupled to said support member and adapted to move said support member along said linear path to move said arm member along said arcuate path.

10. The fluid pressure energy translating device as defined in claim 3 further comprising:

cage means holding said ball and socket joints in position against said thrust plate means;

a collar engaging said cage means, said collar having arcuately spaced recesses facing said cylinder barrel;

spring means in said cylinder barrel; and arcuately spaced rod means extending rearwardly through said cylinder barrel and received in said collar recesses, said spring exerting a force biasing said cylinder barrel toward said valve plate and said cage toward said thrust plate means.

11. A displacement control mechanism for a fluid pressure energy translating device of the axial piston type, said mechanism comprising:

thrust plate means comprising a pivotal yoke having a bearing surface adapted to cooperate with pistons to impart a reciprocal motion thereto, said movable yoke having a pair of axially aligned trunnions defining an axis about which said yoke may be pivoted;

a pair of circular bearings removably insertable about said trunnion pins to rotatably mount said trunnion pins to said device, said trunnions having an arcuate length less than the full diameter of said bearings, said trunnions having more than a half diameter to hold said trunnions in place when reverse loads occur thereon;

a coupling pin carried by one of said thrust plate trunnions, said coupling pin being removably attached to said one trunnion, said coupling pin being movable with said trunnion along an arcuate path, said thrust plate being movable along said arcuate path when said coupling pin is moved along said arcuate path; a support member having a through bore slideably receiving said coupling pin, said coupling pin being reciprocally mounted in said housing and movable along a path generally perpendicular to the axis of rotation of said cylinder barrel, said support member pivoting said coupling pin along said arcuate path when said support member is moved along said linear path and said coupling pin reciprocally slides within said support member bore whereby the degree of inclination of said thrust plate with respect to the axis of rotation of said cylinder barrel may be selectively varied; and a control mechanism carried by said housing and operatively coupled to said support member and adapted to move said support member along said linear path to move said coupling pin along said arcuate path.

12. A fluid pressure energy translating device of the axial piston type, said device comprising:

a longitudinally disposed housing;

a longitudinally disposed cylinder barrel rotatably mounted within said housing, said cylinder barrel having a plurality of arcuately spaced cylinder bores and cylinder ports communicating each of said cylinder bores with one end of said cylinder barrel;

a plurality of pistons with inner ends disposed for reciprocal stroking movement within said cylinder bores, one end of each of said pistons projecting from the other end of said cylinder barrel bores;

a valve face having arcuate passages, said valve face and said one end of said cylinder barrel being disposed for relative rotary movement with said cylinder ports communicating successively with said arcuate passages in said valve face;

thrust plate means disposed adjacent said other end of said cylinder barrel and mounted in said housing for inclination about an axis at right angles to the longitudinal axis of said cylinder barrel;

spherical ball and socket joints between the projecting ends of said pistons and said thrust plate means to provide for reciprocation of said pistons in said cylinder bores relative to said cylinder barrel in response to the rotation of said cylinder barrel relative to said thrust plate;

said thrust plate means comprising a pivotal yoke having a bearing surface adapted to cooperate with said piston ball and socket joints to impart a reciprocal motion thereto, said movable yoke having a pair of axially aligned trunnions defining an axis about which said yoke may be pivoted;

a pair of circular bearings removably insertable about said trunnion pins to rotatably mount said trunnion pins to said housing, said trunnions having an arcuate length less than the full diameter of said bearings, said trunnions having more than a half diameter to hold said trunnions in place when reverse loads occur thereon;

a coupling pin carried by said thrust plate trunnion, said coupling pin being removably attached to said trunnion, said coupling pin being movable with said trunnion along an arcuate path, said thrust plate being movable along said arcuate path when said coupling pin is moved along said arcuate path;

a support member having a through bore slideably receiving said coupling pin, said coupling pin being reciprocally mounted in said housing and movable along a path generally perpendicular to the axis of rotation of said cylinder barrel, said support member pivoting said coupling pin along said arcuate path when said support member is moved along said linear path and said coupling pin reciprocally slides within said support member bore whereby the degree of inclination of said thrust plate with respect to the axis of rotation of said cylinder barrel may be selectively varied; and a control mechanism carried by said housing and operatively coupled to said support member and adapted to move said support member along said linear path to move said coupling pin along said arcuate path.

13. The fluid pressure energy translating device defined in claim 12 further comprising means providing lateral support for said cylinder barrel, said lateral support means having a shaft which supports said barrel; axially spaced bearing means carried by said housing, said bearing means supporting said shaft, said shaft having a coaxial, annular land intermediate said axially spaced bearing means, said land being engaged with the other end of said cylinder barrel to laterally support the barrel coaxially of the shaft, said land having a lateral centerline spaced axially outwardly from the point of intersection of the shaft axis with the general plane of a locus of the centers of the spherical balls at said projecting ends of said pistons and located in a plane between said plane of said centers and one end of said cylinder barrel.

14. The fluid pressure energy translating device defined in claim 12, said device comprising a pair of circular bearings removably insertable about said trunnion pins to rotatably mount said trunnion pins to said housing, said trunnions having an arcuate length less than the full diameter of said bearings, said trunnions having more than a half diameter to hold said trunnions in place when reverse loads occur thereon.

15. The fluid pressure energy translating device defined in claim 12 wherein said bearing surface has a diameter "D" and the distance from the center of said bearing surface to the edge of said trunnions is 0.8 D, said trunnions having a diameter of 0.5 D.

* * * * *